US006896631B1

(12) United States Patent
Fairchild

(10) Patent No.: US 6,896,631 B1
(45) Date of Patent: May 24, 2005

(54) DEVICE AND METHOD FOR TRAINING AN UNDERHAND PITCHER

(76) Inventor: Michael J. Fairchild, 89 Goldengate Rd., Levettown, PA (US) 19057

( * ) Notice: Subject to any disclaimer, the term of this patent is extended or adjusted under 35 U.S.C. 154(b) by 0 days.

(21) Appl. No.: 10/357,963

(22) Filed: Feb. 5, 2003

(51) Int. Cl.[7] ..... A63B 69/00
(52) U.S. Cl. ..... 473/458; 473/422; 473/450
(58) Field of Search ..... 473/415, 422, 473/450, 458, 464, 59, 205–213

(56) References Cited

U.S. PATENT DOCUMENTS

| | | | | | |
|---|---|---|---|---|---|
| 2,228,586 | A | * | 1/1941 | Protzky | 473/518 |
| 3,190,658 | A | * | 6/1965 | Kane | 473/227 |
| 4,688,800 | A | * | 8/1987 | Lopez | 473/215 |
| 5,135,446 | A | * | 8/1992 | Cooley | 482/51 |
| 5,178,598 | A | | 1/1993 | Finch | |
| 5,390,929 | A | * | 2/1995 | Todaro | 473/215 |
| 5,441,255 | A | | 8/1995 | Verbick | |
| D369,391 | S | * | 4/1996 | Jump, Jr. | D21/685 |
| 6,012,993 | A | * | 1/2000 | Guerriero | 473/424 |
| 6,428,421 | B1 | * | 8/2002 | Halfacre | 473/215 |
| 6,582,318 | B1 | * | 6/2003 | Halfacre | 473/215 |
| 2003/0148833 | A1 | * | 8/2003 | O'Hara | 473/458 |

FOREIGN PATENT DOCUMENTS

WO WO 85/04337 A * 10/1985

* cited by examiner

*Primary Examiner*—Mitra Aryanpour
(74) *Attorney, Agent, or Firm*—LaMorte & Associates

(57) ABSTRACT

A device and method for training a person to move their arm in the vertical plane as a person throws, tosses or rolls and object. The device includes a flap that attaches either to the body or the clothing of the person being trained. The flap extends out laterally from the side of the body. As a person throws, tosses or rolls an object with an underhand motion, that person's arm will contact the flap if the arm is moving in the vertical plane. This provides a person with a tactile indication as to whether or not they are moving the arm in proper form.

12 Claims, 4 Drawing Sheets

DEVICE AND METHOD FOR TRAINING AN UNDERHAND PITCHER

BACKGROUND OF THE INVENTION

1. Field of the Invention

The present invention relates to training devices used to train a person in the proper movement of their pitching arm when pitching a ball or other projectile with an underhand pitch.

2. Prior Art Statement

There are several sports where a pitcher pitches an object underhand. Two of the most popular sports that use underhand pitching include softball and horseshoes. Other sports that use underhand pitching motions include bowling, curling and bocce. With all of these activities, a common underhand arm motion is used. Furthermore, as with all physical activity, the more a person practices and trains, the better that person becomes in performing that activity.

In order to manually throw, toss or roll any object accurately, a person must be able to consistently control the direction of the object before that object is released from the hand. With most all of the activities previously mentioned, it is desired that the object being thrown, tossed or rolled is done so, straight. If the object being thrown, tossed or rolled is consistently straight, a person can then master both control and accuracy.

When throwing, tossing or rolling an object underhand, the arm grasping that object rotates about the shoulder. In order to throw, toss or roll an object consistently straight, the arm should rotate about the shoulder only in the vertical plane. If the arm is rotating only in the vertical plane, the object will initially travel in that same plane when released. Any deviation from this path would only be caused by the spin and aerodynamics of the object, not from its initial direction when released. Accordingly, in order to better train people to accurately throw, toss or roll objects underhand, a person must practice moving their arm only in the vertical plane prior to releasing the thrown, tossed or rolled object.

In the prior art, there are many different types of training devices for many different types of sports. Some of these training devices are intended for people who throw, toss or roll objects underhand. For example, in U.S. Pat. No. 5,441,255 to Verbick, entitled Practice Device For Bowling And Other Sports, a training machine is shown for helping a bowler train. The training machine uses a rail that is arranged in the vertical plane. A person using the training machine moves a weight along the rail. As such, the training machine strengthens the muscles used to roll a bowling ball and helps create muscle memory so that the bowler will only move their arm in the vertical plane when swinging the bowling ball.

However, training devices such as that shown in the Verbick patent are expensive and they cannot be used when actually bowling, which is where, when and how most bowlers train. Furthermore, the rail used in the Verbick patent does not create a complete circle. As such, the training machine of the Verbick patent cannot be used to train softball pitchers that move their arms through full circular rotations.

Training devices for softball pitchers are limited in the prior art record. Most training devices for softball pitching involve little more than a target at which a pitch is to be aimed. Other devices provide tethered balls that enable a pitcher to pitch a softball and quickly get that softball back.

Such prior art softball pitching training devices are exemplified by U.S. Pat. No. 5,178,598 to Finch, entitled, Exerciser For Softball Pitchers. However, as can be seen, such devices do not prevent a softball pitcher from moving their arm outside of the vertical plan when pitching.

A need therefore exists for a training device that can be used by any person who throws, tosses or rolls an object with an underhand motion, wherein that training device helps a person maintain their arm in the vertical plane, and can be used while a person is actually throwing, tossing or rolling that object. This need is met by the present invention as described and claimed below.

SUMMARY OF THE INVENTION

The present invention is a training device for throwing an object underhand. The training device includes a flap having a flat front surface and a flat rear surface defined between a plurality of common edges, wherein the plurality of common edges includes a mounting edge. An attachment mechanism is provided that extends from the mounting edge of the flap. The attachment mechanism is used for attaching the flap to a user's body or clothing between the waist and knee. Once attached in such a position, the flap extends laterally from the user's body or clothing.

As a person throws, tosses or rolls an object underhand, their arm will contact the flap only if their arm is moving in the vertical plane. Accordingly, the flap provides a person with a tactile indication as to whether or not they are maintaining their arm in the vertical plane as they throw, toss or roll an object underhand.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention training device can be used to train any person who throws, tosses or rolls an object underhand, such as bowlers, horseshoe players and the like, the present invention is especially well suited for training softball pitchers. Consequently, the present invention will be described in the application of training a softball pitcher in order to set forth the best mode contemplated for the invention. Such an exemplary application of the present invention, however, should in no way be considered a limitation of the present invention training device and it will be understood that it can be used for other sports and activities other than softball.

Figure 1:
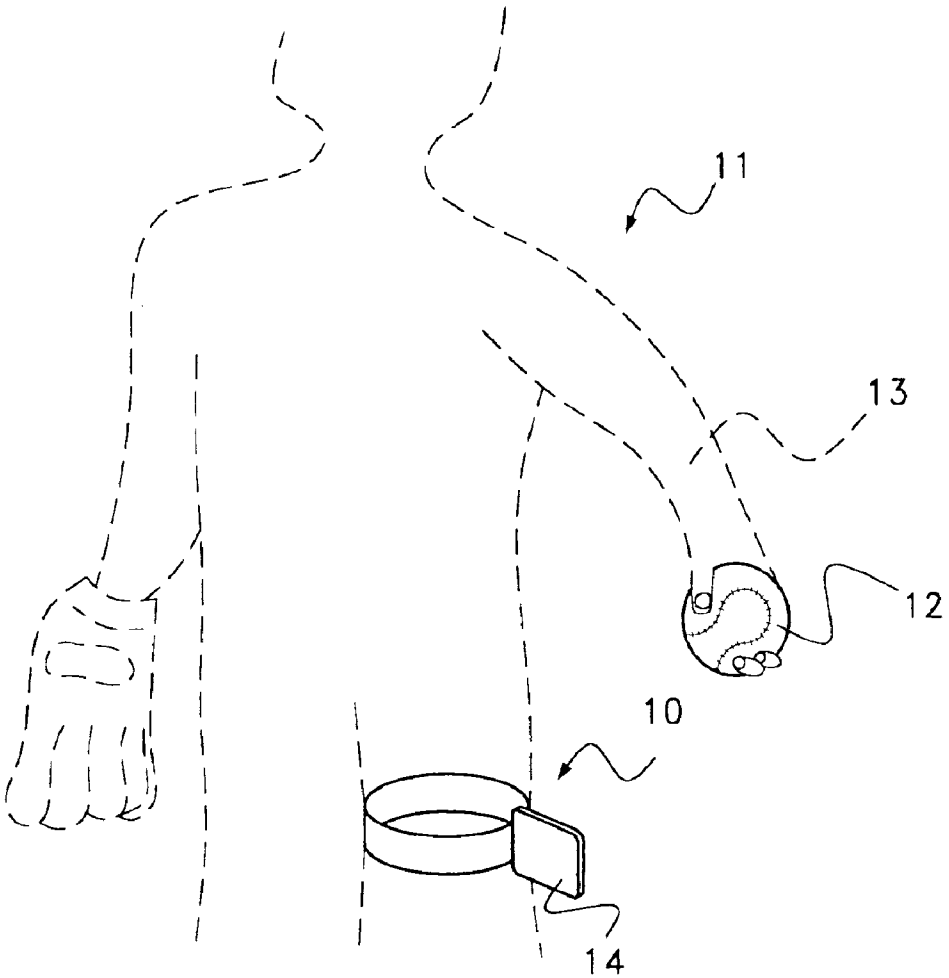
FIG. 1 is a perspective view of an exemplary embodiment of the present invention affixed to the leg of a softball pitcher.

Referring to FIG. 1, an exemplary embodiment of the present invention training device 10 is shown being worn by a softball pitcher 11. When a softball pitcher 11 pitches a softball 12, the softball 12 is pitched underhand. Good softball pitchers typically hold their arm straight and rotate their pitching arms around their shoulder joints to pitch. Softball pitchers typically wind up their arm prior to any pitch. In order to throw the softball 12 straight, it is important that the softball pitcher 11 both wind up their arm 13 prior to the pitch, and move their arm 13 during the pitch in the vertical plane Vp. If the pitcher's arm 13 is moved in the vertical plane Vp, the softball 12 will move straight away from the pitcher 11 when released. However, if the arm 13 is moved outside the vertical plane Vp during a pitch, lateral forces are applied to the softball 12 that cause the softball 12 not to fly straight when released.

Figure 2C:
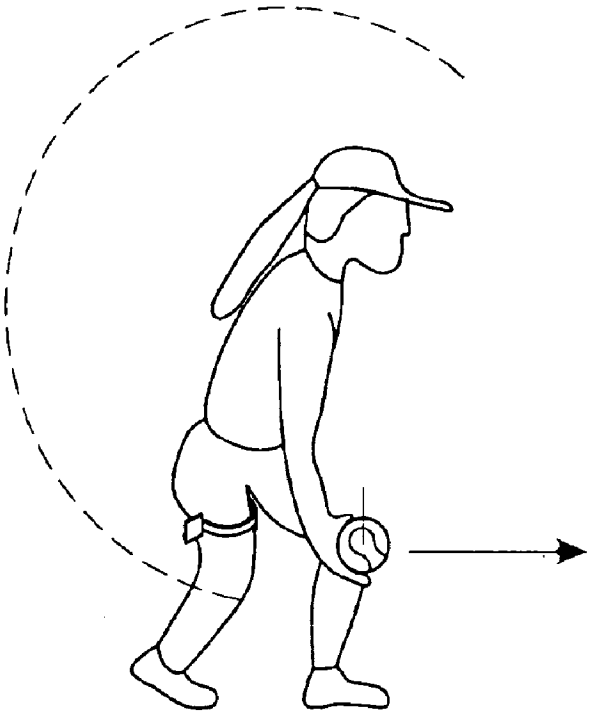
FIG. 2C is a side view of a pitcher ending a pitch while using the present invention training device.

The present invention training device 10 includes a flap 14 that extends laterally from the leg or waist of the pitcher 11. The flap 14 extends between two and eight inches from the side of the pitcher's body. Referring to FIG. 2A, it can be seen that when a pitcher 11 winds up for a pitch, the pitcher's arm 13 passes the flap 14. Since the pitcher's arm 13 extends out a few inches from the side of the body and the flap 14 extends a few inches from the side of the body, it will be understood that if the pitcher's arm movement is in the vertical plane Vp, the pitcher's arm 13 will touch the flap 14 as it passes the flap 14.

Accordingly, during the wind up for the pitch, a pitcher 11 is provided a tactile indication by the flap 14 that the wind up movement is in the proper vertical plane Vp.

Figure 2B:
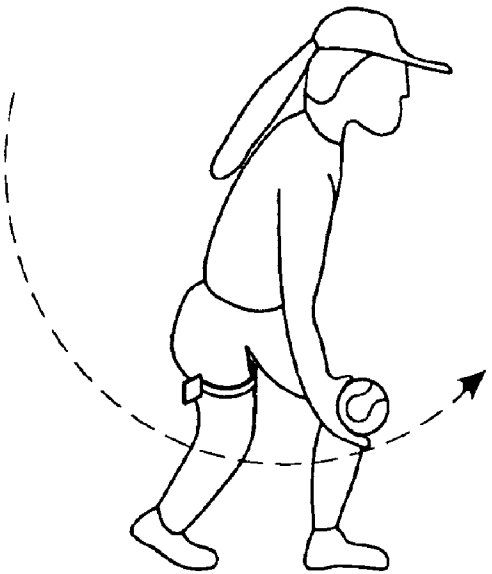
FIG. 2B is a side view of a pitcher midway through a pitch while using the present invention training device.
Figure 2A:
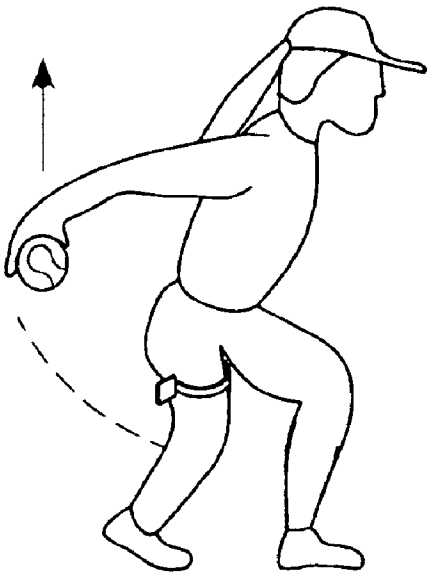
FIG. 2A is a side view of a pitcher beginning a pitch while using the present invention training device.

Referring to FIG. 2B, it will be understood that as a pitcher 11 begins the pitching motion, the pitcher's arm 13 again passes the flap 14 when beginning the pitching motion. Again, the pitcher's arm 13 will contact the flap 14 if the pitcher's arm 13 is moving in the vertical plane Vp. Accordingly, during the beginning of the pitch, a pitcher 11 is provided with a tactile indication by the flap 14 that the beginning of the pitching motion is maintaining the arm 13 in the vertical plane.

Referring to FIG. 2C, it will be understood that as the full round arm swing of the pitch comes around, the pitcher's arm 13 will again contact the flap 14 just before the softball 12 is released, if the pitcher's arm 13 is traveling in the vertical plane Vp. Accordingly, at the end of the pitch, a pitcher 13 is provided with a tactile indication by the flap 14 that the end of the pitching motion has maintained the arm 13 in the vertical plane Vp.

From the full pitch, expressed collectively in FIGS. 2A, 2B and 2C, it will be understood that a softball pitcher 11 is provided three separate tactile indications during the pitch. Each of the tactile indications informs the pitcher 11 as to whether or not their arm 13 is moving in the vertical plan. Since one tactile indication occurs during the wind-up of the pitch, one tactile indication occurs at the beginning of a pitch, and the last tactile indication occurs at the end of the pitch, a pitcher 11 can know whether or not the arm 13 is in proper form throughout the pitch. If any of the tactile indications is missed, a pitcher 11 knows whether or not the wind-up, beginning of the pitch or end of the pitch is out of proper form.

Figure 3:
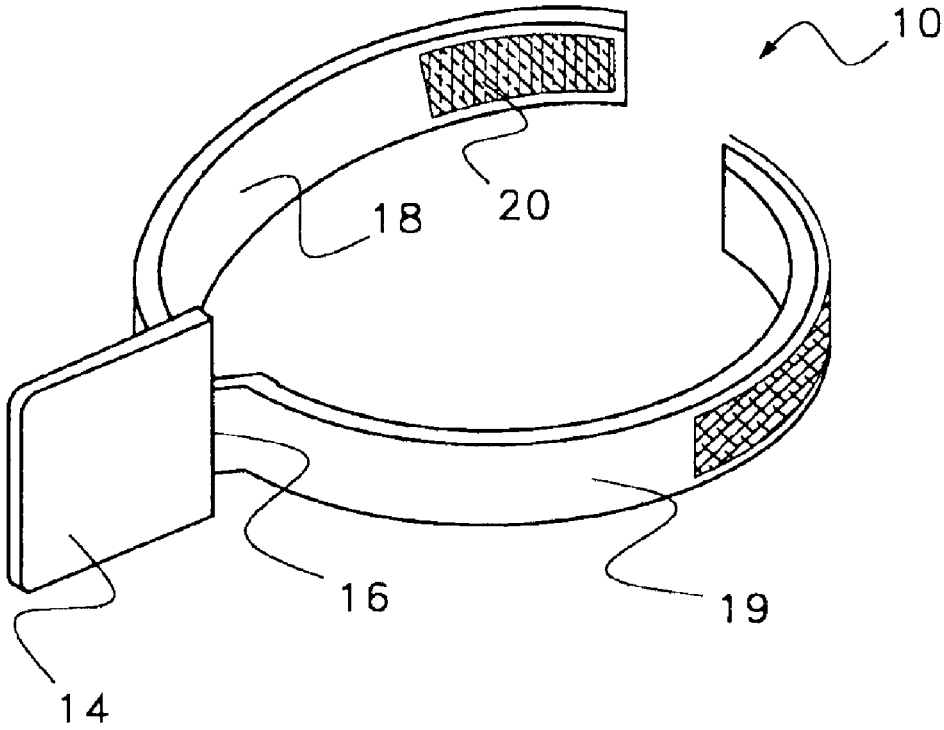
FIG. 3 is a perspective view of a first exemplary embodiment of the present invention training device.

Referring to FIG. 3, a first exemplary embodiment of the present invention training device 10 is shown. The training device 10 has a flap 14. The flap 14 is made of cloth or elastomeric material so that the flap 14 is highly flexible yet will not harm a person's arm when a person's arm contacts the flap 14 while pitching. The flap has a flat front surface and a flat back surface that are defined between a plurality of common edges. One edge of the flap is the mounting edge 16. The flap 14 can be rectangular, square, triangular or any other selected shape. However, regardless of the shape selected, the flap 14 should extend away from the body by at least two inches and preferably four to six inches. The flap 14 can have any thickness. However, the flap must have a thickness thin enough to be pliable, but not too thick as to effect the movement of the pitcher's arm. A thickness of under ¼ inch is therefore preferred. Furthermore, the flap 14 must have a thickness sufficient enough to prevent the flap from folding under its own weight when suspended from the side of a pitcher's body. In this manner, the flap remains in the vertical plane as it extends from the pitcher's body.

In the shown embodiment, two straps 18, 19 extend from the flap 14. The straps 18, 19 are elastic or contain elastic threading. Sections of the straps 18, 19 are covered in hook and loop material 20, such as Velcro(™). As such, the two straps 18, 19 can be interconnected creating an elastic hoop structure of an adjustable diameter. The straps 18, 19 are used to connect the training device 10 either around the leg or the waist of the person being trained. The training device 10 is oriented so that the straps 18, 19 support the flap 14 vertically from the side of the body.

It will be understood that many strap configurations exist that can be used in place of the specific strap configuration illustrated. For example, a single continuous elastic strap can be used so that the one size would fit all. Alternatively, straps can be provided with buckles, snaps and many other types of adjustable connection devices. What is important is that the strap configuration is capable of being affixed to the body firmly enough to support the flap 14 on the side of the body during a period of pitching.

The use of any strap configuration itself is merely exemplary. The present invention training device 10 is a flap 14 that is supported on the side of a pitcher's body so that a pitcher gets tactile indications as to whether or not they are pitching in good form. The mechanism used to support the flap 14 on the side of the body can be varied in many ways.

Figure 4:
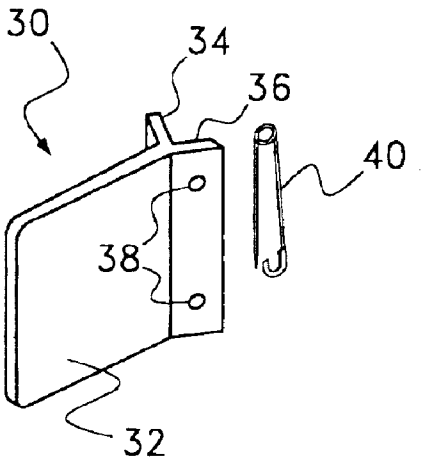
FIG. 4 is a perspective view of a second exemplary embodiment of the present invention training device.

Referring to FIG. 4, such an alternate embodiment of the present invention training device 30 is shown. In FIG. 4, a flap is shown having a Y-configuration, wherein there is a main flap 32 and two smaller flap arms 34, 36 that extend from the main flap 32. Grommet holes 38 are disposed in each of the smaller flap arms 34, 36. Safety pins 40 can be closed through the grommet holes 38, thereby enabling the two smaller flaps 34, 36 to be pinned to a pair of shorts or sweat pants worn by a pitcher. Once pinned into place, the pinned smaller flaps 34, 36 support the main flap 32 out laterally from the side.

Figure 5:
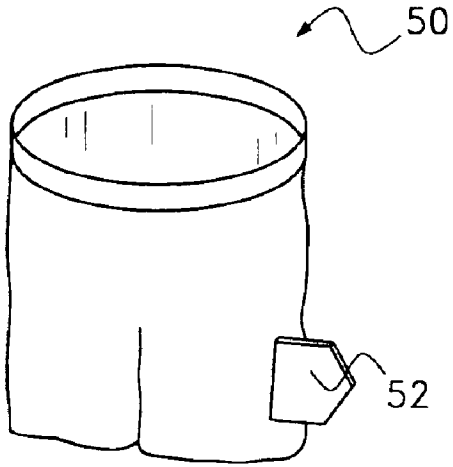
FIG. 5 is a perspective view of a third exemplary embodiment of the present invention training device.

Referring to FIG. 5, a pair of pitching shorts 50 are shown. On one leg of the shorts is sewn a flap 52 in accordance with the present invention. The flap 52 extends laterally from one leg of the shorts 50. Other than being sewn to the shorts 50, the flap 52 has the same shape and characteristics as the flaps previously described.

Figure 6:
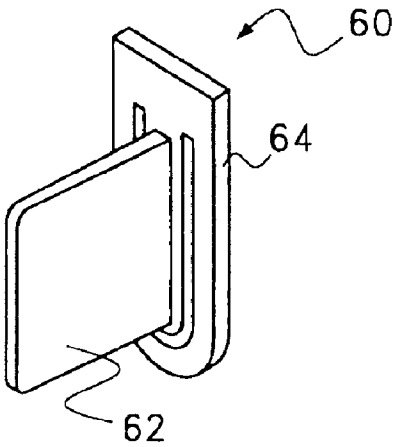
FIG. 6 is a perspective view of a fourth exemplary embodiment of the present invention training device.

Referring lastly to FIG. 6, a training device 60 is provided consisting of a flap 62 and a clip element 64 that supports the flap 62. The clip element 64 passes over the waistline of any shorts or pants worn by the pitcher. The clip element 64 engages the material of the pants or shorts at the waistline and supports the flap 62 out laterally away from the clothing. Other than its means of attachment to the clothing, the flap 62 has the same shape and characteristics as the flaps previously described.

It will be understood that the embodiments of the present invention training device that are described and illustrated herein are merely exemplary and a person skilled in the art can make many variations to the embodiment shown without departing from the scope of the present invention. For example, in the shown embodiments, the flaps are shown to be either square or rectangular. Other shapes for the flap can be used. Furthermore, the shown embodiments are described as being used to train a softball pitcher. It will be understood that the present invention training device is just as effective in training bowlers, horseshoe players, curlers and any other person who throws, tosses or rolls an object underhand. All such variations, modifications and alternate embodiments are intended to be included within the scope of the present invention as defined by the appended claims.

What is claimed is:

1. A method of training a softball pitcher in the proper mechanics of pitching arm movement during an underhand pitch, said method comprising the steps of:

providing a flexible flap that is both thin and pliable enough not to adversely effect the movement of a pitcher's arm if contacted by the pitcher's arm during the underhand pitch;

attaching the flexible flap to one of a waistline or leg of the pitcher so that the flap extends laterally a predetermined distance from the pitcher's body on the same side of the pitcher's body as the pitcher's arm said flap having a thickness sufficient enough to prevent the flap from folding under its own weight when attached to the pitcher; and having the pitcher perform an underhand pitch, wherein said pitcher's arm contacts and passes through the flexible flap at least one time, therein providing a tactile indication to the pitcher that the pitcher's arm is within said predetermined distance of the pitcher's body during the underhand pitch.

2. The method according to claim 1, wherein said step of attaching the flexible flap to the leg of the pitcher includes providing a strap that is attached to the flexible flap and securing the strap around the leg of the pitcher so that the flexible flap extends laterally from the pitcher's leg.

3. The method according to claim 1, wherein said step of attaching the flexible flap to the pitcher one of a waistline or leg of the includes providing a mechanical fastener that is attached to the flexible flap and securing the mechanical fastener to the clothing of the pitcher so that the flexible flap extends laterally from the pitcher's clothing.

4. The method according to claim 3, wherein said mechanical fastener is selected from a group consisting of pins and clips.

5. The method according to claim 1, wherein said step of attaching the flexible flap to the pitcher leg of the includes providing an article of clothing that is to be worn by the pitcher and sewing the flexible flap to the article of clothing so that the flexible flap extends laterally from the pitcher's clothing.

6. The method according to claim 1, wherein said step of having the pitcher perform an underhand pitch includes having the pitcher's arm move in a first direction during a windup movement and move in an opposite second direction during a throwing movement.

7. The method according to claim 6, wherein said pitcher's arm contacts and passes through the flexible flap once during said windup movement and at least once during said throwing movement, therein providing a tactile indication to the pitcher that the pitcher's arm is within said predetermined distance of the pitcher's body during both the windup movement and the throwing movement.

8. A method of providing a tactile indication to a pitcher that the pitchers arm is moving in a vertical plane during an underhand pitch, said method comprising the steps of:

attaching a flexible flap to one of a waistline or leg of the pitcher so that the flap extends laterally a predetermined distance from the pitcher's body on the same side of the pitcher's body as the pitcher's arm said flap having a thickness sufficient enough to prevent the flap from folding under its own weight when attached to the pitcher;

having the pitcher perform an underhand pitch that includes a windup movement and a throwing movement, wherein said pitcher's arm contacts and passes through said flexible flap at least once during said windup movement and at least once during said throwing movement if the pitchers arm remains in the vertical plane during the underhand pitch.

9. The method according to claim 8, wherein said step of attaching the flexible flap to the pitcher leg of the includes providing a strap that is attached to the flexible flap and securing the strap around the leg of the pitcher so that the flexible flap extends laterally from the pitcher's leg.

10. The method according to claim 8, wherein said step of attaching the flexible flap to the pitcher one of a waistline or leg of the includes providing a mechanical fastener that is attached to the flexible flap and securing the mechanical fastener to the clothing of the pitcher so that the flexible flap extends laterally from the pitcher's clothing.

11. The method according to claim 10, wherein said mechanical fastener is selected from a group consisting of pins and clips.

12. The method according to claim 8, wherein said step of attaching the flexible flap to the pitcher leg of the includes providing an article of clothing that is to be worn by the pitcher and sewing the flexible flap to the article of clothing so that the flexible flap extends laterally from the pitcher's clothing.

* * * * *